US007686298B2

(12) United States Patent
Fioravanti et al.

(10) Patent No.: US 7,686,298 B2
(45) Date of Patent: Mar. 30, 2010

(54) METHOD AND SYSTEM FOR CORRECTING LATERAL POSITION ERROR

(75) Inventors: Alexander J. Fioravanti, Penfield, NY (US); Rakesh Suresh Kulkarni, Webster, NY (US); Abu Islam, Rochester, NY (US); Keith Andrew Buddendeck, Rochester, NY (US); Saurabh Prabhat, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 119 days.

(21) Appl. No.: 11/934,966

(22) Filed: Nov. 5, 2007

(65) Prior Publication Data

US 2009/0115124 A1 May 7, 2009

(51) Int. Cl.
*B65H 7/02* (2006.01)

(52) U.S. Cl. ..... 271/228

(58) Field of Classification Search ..... 271/227, 271/228

See application file for complete search history.

(56) References Cited

U.S. PATENT DOCUMENTS

| | | | | |
|---|---|---|---|---|
| 4,641,828 | A * | 2/1987 | Yajima | 271/227 |
| 5,225,877 | A | 7/1993 | Wong | |
| 5,383,006 | A | 1/1995 | Castelli | |
| 6,488,275 | B2 * | 12/2002 | Schlageter | 271/10.01 |
| 6,550,621 | B2 * | 4/2003 | Fukatsu et al. | 209/534 |
| 6,581,929 | B2 * | 6/2003 | Hiramitsu | 271/228 |
| 7,083,167 | B2 * | 8/2006 | Barthold | 271/228 |
| 2003/0098985 | A1 | 5/2003 | Horobin | |
| 2004/0114025 | A1 | 6/2004 | Kerxhalli et al. | |
| 2006/0092257 | A1 | 5/2006 | Dejong et al. | |
| 2006/0163801 | A1 | 7/2006 | Dejong et al. | |
| 2006/0171725 | A1 | 8/2006 | Ruthenberg et al. | |
| 2006/0197038 | A1 | 9/2006 | Park et al. | |
| 2007/0023994 | A1 | 2/2007 | Mandel et al. | |
| 2008/0012214 | A1 * | 1/2008 | Elliot | 271/227 |
| 2008/0012215 | A1 * | 1/2008 | Elliot | 271/228 |
| 2008/0296835 | A1 * | 12/2008 | Dejong et al. | 271/227 |
| 2009/0152806 | A1 * | 6/2009 | Buddendeck et al. | 271/228 |

* cited by examiner

*Primary Examiner*—Patrick H Mackey
*Assistant Examiner*—Gerald W McClain
(74) *Attorney, Agent, or Firm*—Fay Sharpe LLP

(57) ABSTRACT

A method of removing media lateral DC position errors in a long paper path using closed loop correction is disclosed. The amount of lateral DC media shift error generated (or the lateral DC correction required) in the paper path is sensed by a CCD or full width array sensor located in the downstream paper path. In the closed loop, this information is used to energize a motorized actuator in the upstream paper path to correct for lateral DC errors in the media path. Thus, the paper is delivered to the downstream media path within specifications.

17 Claims, 6 Drawing Sheets

METHOD AND SYSTEM FOR CORRECTING LATERAL POSITION ERROR

BACKGROUND

Disclosed herein are various embodiments of an improved method and system for correcting lateral position errors in image rendering systems.

By way of background, digital copiers are well known. Whereas a traditional "analog" copier in effect directly takes a photograph of the image desired to be copied, in a digital copier an original image on an input sheet is recorded as digital data, and the digital data is used to create a print which is a copy of the original image. The original image is typically recorded by an array of photosensors, such as in a charge-coupled-device (CCD), while the printing step is typically carried out by familiar "ink-jet" technology, or by digital "laser printer" rendering in a xerographic apparatus.

Between the recording of the original image and the output of a resulting print, the image data can be processed and manipulated, such as through digital image processing, in any number of ways. Chief among these ways is alteration of the placement of the image relative to a print sheet on which the image is ultimately rendered: the placement of the image further involves consideration of hardware-related factors such as the start-of-scan control in a scanning laser which creates a latent image on a photoreceptor in a xerographic printer, or the precise control of a moving printhead in an ink-jet apparatus. Another aspect of processing image data between recording and printing relates to the magnification of the image.

Ideally, in a basic case, it is desirable that a copy output by a digital copier be as similar to the original image as possible, particularly in the aspects of placement of the image relative to the edge of the print sheet, as well as magnification of the printed image relative to the original.

Now, in any long paper path, due to the increase in the number of paper path nips, there is an increase in paper lateral walk (or displacement). At least one cause of this lateral walk is the misalignment of drive rolls, idler rolls, and mechanical assembly tolerances. The longer paper path causes the paper to walk outside of the input tolerances of the downstream subsystems, thus causing misregistration, marks or jams, depending on the downstream subsystem present.

A registration module may be used to correct for lateral and process position and paper skew. However, the performance of the registration module is based on a trade-off between lateral, process, and skew correction, due to the amount of time that the sheet is in the registration nip. Since the registration module has to work at correcting three aspects—paper skew, paper process position and paper lateral position—there is a limited amount of process and skew correction that can be achieved when correcting large lateral position errors. If the DC lateral shift can be corrected before the sheet arrives at the registration module, then the registration module can correct for larger errors in media process position and media skew.

Thus, the exemplary embodiment disclosed herein relates to an automatic method by which a digital copier can be adjusted to reduce DC lateral position errors prior to registration.

BRIEF DESCRIPTION

A method of removing media lateral DC position errors in a long paper path using closed loop correction is disclosed. The amount of lateral DC media shift error generated (or the lateral DC correction required) in the paper path is sensed by a CCD or full width array sensor located in the downstream paper path. In the closed loop, this information is used to energize a motorized actuator in the upstream paper path to correct for lateral DC errors in the media path. Thus, the paper is delivered to the downstream media path within specifications.

In accordance with an aspect of the exemplary embodiment, a closed loop pre-registration method for an image rendering system. The method comprises: passing more than one sheet through an image sensing unit of a registration system in the image rendering system, wherein the image rendering system has a paper path comprised of more than one image processing module; collecting a running average of the lateral position error of each sheet; calculating the DC lateral position error of the sheets; feeding the DC lateral position error to a controller; and shifting at least one upstream paper path module via a tension control mechanism to reduce the DC lateral position error for future sheets.

In accordance with another aspect of the exemplary embodiment, a closed loop pre-registration system for an image processing device having a paper path with two or more image processing modules, the system comprising: a registration system having an image sensing unit; a controller; a feedback loop between the image sending unit and the controller; and a tension control mechanism adapted to shift one of the image processing modules in the paper path upon receipt of a signal from the controller.

In accordance with yet another aspect of the exemplary embodiment, a method is provided. The method comprises: collecting a running average of the lateral position error for a plurality of sheets as they pass through an image sensing unit of an image registration system; feeding the DC lateral position error to a controller; and shifting at least one upstream paper path module via a tension control mechanism to reduce the DC lateral position error for future sheets.

DETAILED DESCRIPTION

Figure 1:
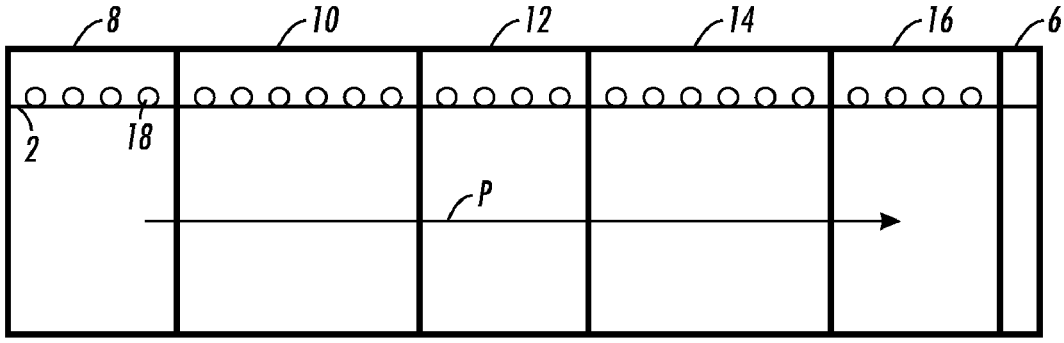
FIG. 1 is a side view of an exemplary paper path.
Figure 2:
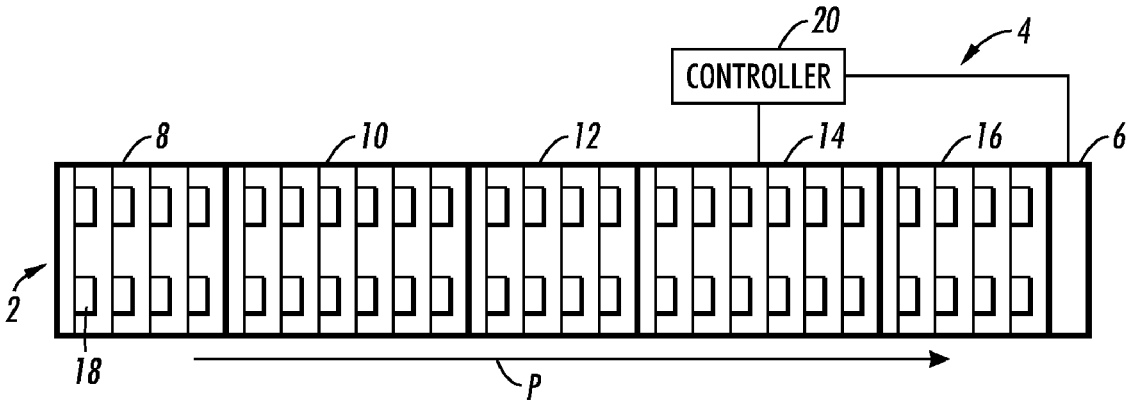
FIG. 2 is a top view an exemplary paper path.

Disclosed herein is a closed loop pre-registration system that reduces or removes DC lateral error in an image rendering system. The system generally involves the racking of a paper path module upstream, and, by means of an actuator, correcting for media lateral position errors. An image sensing module, such as a charge coupled device (CCD) sensor or a full width array sensor, may be used downstream of the actuator to sense the media lateral position. A closed loop system is thus used to correct large DC lateral shifts that may be created in long paper paths. The paper path module is generally a rigid module that can pivot on one end with a linear actuator on the other end to position the paper path module to remove the DC component of the media's lateral position.

The terms "image rendering system" and "copier" as used herein broadly encompass various printers, copiers or multifunction machines or systems, xerographic or otherwise, unless otherwise defined in a claim. The terms "media" and "sheet" as used herein refer generally to a usually flimsy physical sheet of paper, plastic, or other suitable physical substrate for images, whether precut or web fed.

As to specific components of the subject apparatus or methods, or alternatives therefore, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Describing now in further detail these exemplary embodiments with reference to the figures, a closed loop lateral position error correction (or pre-registration) system may be installed in a selected location or locations of the paper path or paths of various conventional printing machines, for correcting a sequence of sheets, as discussed above. Therefore, in FIGS. 1-4, only a portion of an exemplary paper path 2 need be illustrated here. A closed loop pre-registration system 4 for aligning sheets for further downstream registration and processing is shown. The system 4 may be used to control the feed of a copy sheet or media (not shown) along the feed path 2 and position (or register) the lead edge of the copy sheet so that it is fed in proper synchronization to a downstream registration module or work station. The system 4 also aligns (or registers) the side edge of the copy sheet so that it is properly registered in the transverse direction for a downstream registration module 6 or work station.

As shown in FIGS. 1-4, the long media path 2 includes a plurality of image processing modules (8, 10, 12, 14 and 16). The media or copy sheet is typically propelled along the paper path 2 and through the modules by nip roller assemblies 18, which include a drive roller and one or more idler rollers that "pinch" or "nip" the sheet therebetween. The nip roller assemblies are situated at pre-determined intervals along the media path 2, with the intervals generally corresponding to the smallest size sheet being fed through the path 2. While the idler rollers do not drive the sheet directly, they are important in providing the nip force normal to the direction of travel of the sheet to ensure non-slip feeding or transport of the sheet and to help ensure that the substrate travels straight along the path without skewing or translating laterally. These functions of the idler roller are particularly accentuated in a long transport path where accumulated alignment errors may cause jams, or may require expensive re-registration stations to re-align the sheet within the path.

It is necessary that the idler rollers be freely rotatable as well as slightly vertically movable to accommodate different substrate thicknesses passing through the nip roll. This vertical degree of freedom is also necessary to account for variable deformations of the drive roller or to adjust for wear of the nip roller components.

The system 4 further includes a controller 20, which is generally comprised of conventional computer components, including a central processing unit (CPU), memory storage devices for the CPU, and connected display devices, for running one or more computer programs. Such computer program(s) may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The sheet registration system 6, which is located further downstream, may deliver sheets of all kinds to specified positions and angles for subsequent functions within printers, copiers and other image forming devices. The subsequent functions may include transferring an image to the sheet, stacking the sheet, slitting the sheet, etc. In present day high speed copiers and printers, registration systems are used to register the sheets accurately. Conventional registration systems generally correct for skew, lateral offset and process errors. "Skew" is the angle the leading edge of a sheet being transferred differs from perpendicular to the desired direction of transfer. "Lateral offset" or "cross process offset: is the lateral misalignment of the sheet being transferred with respect to the desired transfer path. "Process" relates to the timing of the sheet within the printing machine such that the sheet arrives at various destinations at the proper times.

In a conventional registration system, a sheet is passed over sensor arrays from which the sheet skew, lateral offset, and process errors are calculated. Skew is corrected in some registration systems by rotating drive rollers on opposite ends of a common drive axis at different velocities. Lateral offset may be corrected, for example, by moving the rollers in unison to one side or another. Process errors may be corrected, for example, by driving the rollers faster or slower.

Upon completion of the registration process corrects for skew, lateral offset, and process errors the sheet is aligned along a desired transfer path and ready to receive an image within a pre-defined image area, such as the area defined within 1 inch margins or borders of the sheet. Following the registration process each sheet is delivered to an imaging station where an image is created on the surface of the sheet. In some print engines, the sheet is then passed through a fuser that fuses the image to the sheet. It is typically desirable for the image to be centered within the predefined image area.

Various types of lateral registration and deskew systems are known in the art and optical sheet lead edge and sheet side edge position detector sensors are known which may be utilized in such automatic sheet deskew and lateral registration systems. A recent example is U.S. Pat. No. 6,173,952 to Paul N. Richards, et al. (and art cited therein). As noted, it is particularly desirable to be able to do lateral registration and deskew "on the fly," while the sheet is moving through or out of the reproduction system at normal process (sheet transport) speed. Also, to be able to do so with a system that does not substantially increase the overall sheet path length, or increase paper jam tendencies. The following additional patent disclosures, and other patents cited therein, are noted by way of some examples of sheet lateral registration systems with various means for side-shifting or laterally repositioning the sheet: U.S. Pat. No. 5,794,176 to W. Milillo; U.S. Pat. No. 5,678,159 to Lloyd A. Williams, et al; U.S. Pat. No. 4,971,304 to Lofthus; U.S. Pat. No. 5,156,391 to G. Roller; U.S. Pat. No. 5,078,384 to S. Moore; U.S. Pat. No. 5,094,442 to D. Kamprath, et al; U.S. Pat. No. 5,219,159 to M. Malachowski, et al; U.S. Pat. No. 5,169,140 to S. Wenthe; and U.S. Pat. No. 5,697,608 to V. Castelli, et al.

The sheet lateral registration movement can be done during the same time as, but independently of, the sheet deskewing movement, thereby reducing sheet rotation requirements. These may be broadly referred to as "TELER" systems as described, for example, in U.S. Pat. No. 5,094,442 to Kamprath et al; U.S. Pat. Nos. 5,794,176 and 5,848,344 to Milillo, et al; U.S. Pat. No. 5,219,159 to Malachowski and Kluger; U.S. Pat. No. 5,337,133; and others.

Other art of lesser background interest on both deskewing and side registration, using a pivoting sheet feed nip, includes U.S. Pat. Nos. 4,919,318 and 4,936,527 issued to Lam Wong. Particularly noted as to a pivoting nips deskew and side registration system without such fixed edge guides, which can provide center registration, is the "SNIPS" system of both pivoting and rotating plural sheet feeding balls (with dual, different axis, drives per ball) of U.S. Pat. No. 6,059,284 to Barry M. Wolf, et al.

The registration system 6 may include an image sensing unit (not shown), which comprises any type of electronic sensor including a charge coupled device (CCD) array or a full width array (or imaging bar). A CCD or full width array typically comprises one or more linear arrays of photo-sites, wherein each linear array may be sensitive to one or more colors. In a color image capture device, the linear arrays of photo-sites are used to produce electrical signals which are converted to color image data representing the scanned document. However, in a black-and-white scanner, generally, only one linear array of photo-sites is used to produce the electrical signals that are converted to black and white image data representing the image of the scanned document.

Examples of suitable full width arrays that can be used are disclosed in various patents, including U.S. Pat. No. 5,031,032 to Perregaux, et al.; U.S. Pat. No. 5,473,513 to Quinn; U.S. Pat. No. 5,545,913 to Quinn et al.; U.S. Pat. No. 5,552,828 to Perregaux; U.S. Pat. No. 5,604,362 to Jedlicka et al.; U.S. Pat. No. 5,691,760 to Hosier et al.; U.S. Pat. No. 5,748,344 to Rees; and U.S. Pat. No. 6,621,576 to Tandon et al., each of which is hereby incorporated by reference in its entirety. Such full width arrays typically come already provided with at least three different color filters, such as red, green and blue, overlying three rows of closely spaced light sensor elements (photo-sites), to provide electrical output signals corresponding to the colors of the document image being scanned. Such imaging bars are typically formed by edge butting together a number of individual imaging chips, each having such multiple tiny and closely spaced photo-sites. Generally, there are three rows of such photo-sites on each such chip, as in the assembled imaging bar, with said integral filters for red, green and blue, respectively.

At least one upstream module (e.g., the fourth module 14) may thus be biased by a tension control mechanism, which can take the form of an adjustable force mechanism, such as a linear actuator that moves in a direction perpendicular to the paper path.

Figure 3:
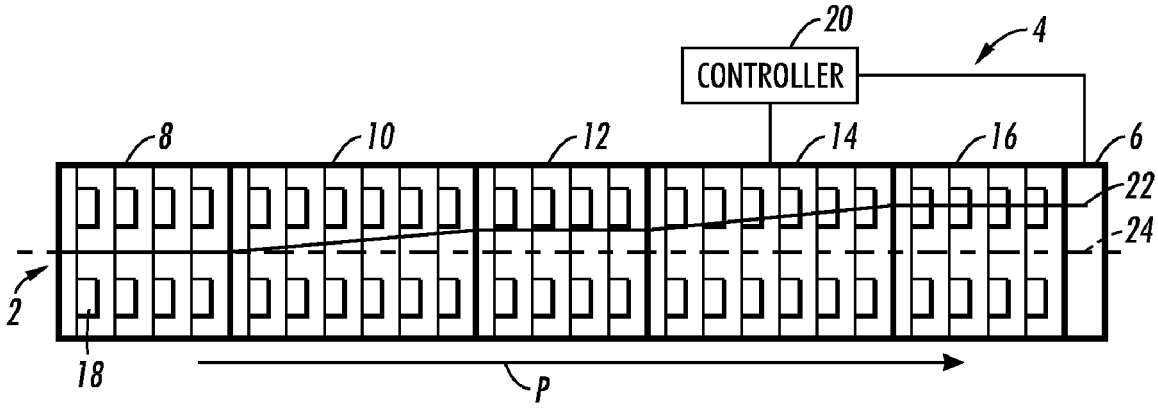
FIG. 3 is a top view of an exemplary paper path showing the centerline of a sheet of media passing uncorrected through the system.

FIG. 3 shows a center line 22 of a sheet of media which has passed uncorrected through the image forming system. A proper center line 24 is also shown for reference. The image sensing unit of the registration system 6 is generally positioned downstream.

Figure 4:
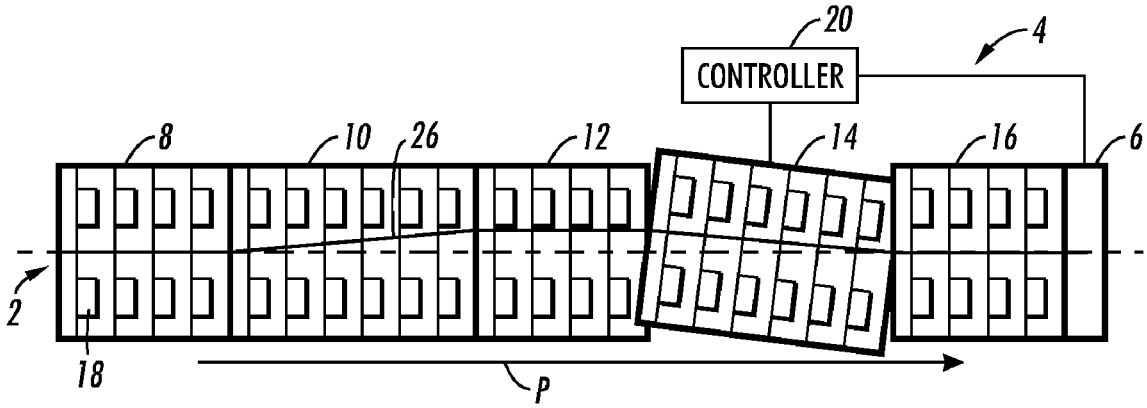
FIG. 4 is a top view of an exemplary paper path showing the centerline of a sheet of media passing corrected through the system.

FIG. 4 shows a centerline 26 of a sheet of media passing corrected through the image forming system. In this example, the fourth module 14 has been shifted to correct for the DC lateral position error.

Figure 5:
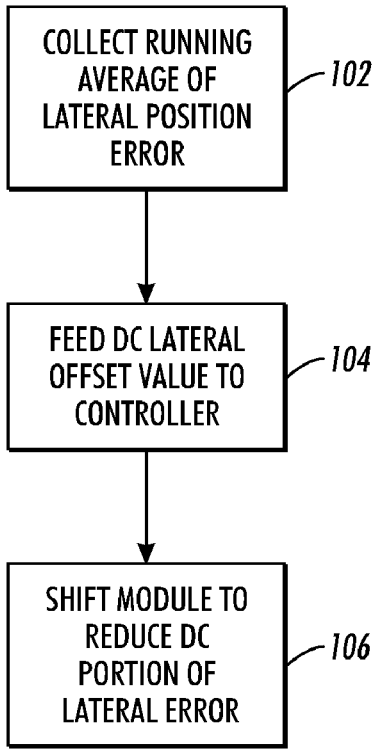
FIG. 5 is a flow chart outlining an exemplary method of correcting lateral position errors in image rendering devices.
Figure 6:
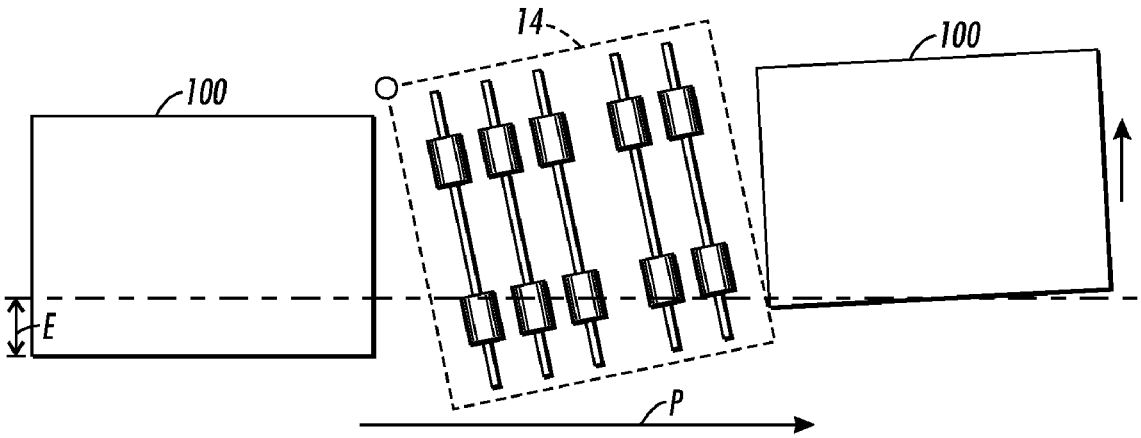
FIG. 6 illustrates media entering with positive lateral offset.
Figure 7:
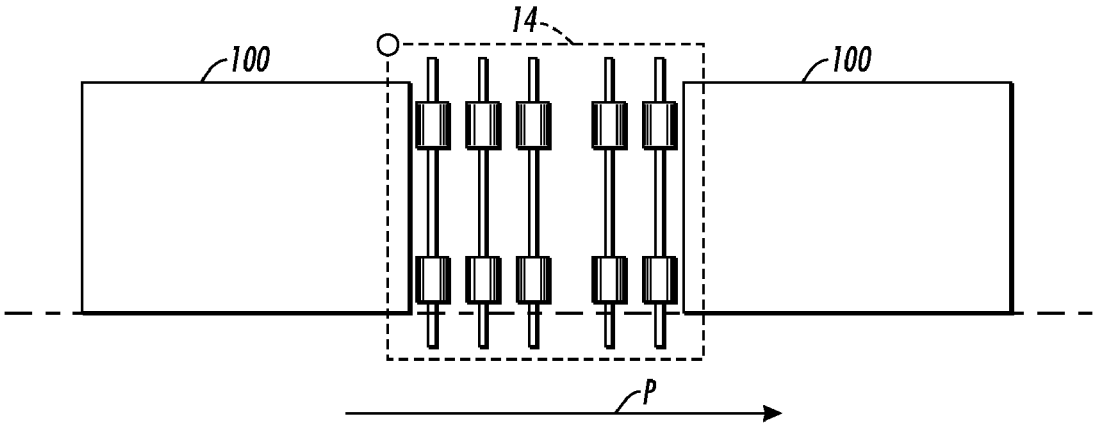
FIG. 7 illustrates media entering with no lateral offset.

With reference now to FIGS. 5-8, a method of correcting DC lateral position error is described. FIG. 6 illustrates the case where media exhibits positive lateral offset. FIG. 7 illustrates the case where the media exhibits no lateral offset.

Figure 8:
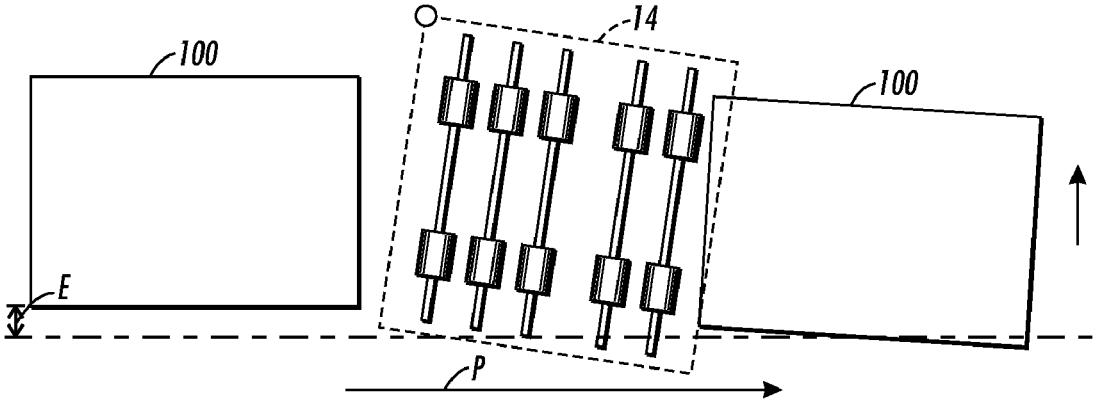
FIG. 8 illustrates media entering with negative lateral offset.

FIG. 8 illustrates the case where the media exhibits negative lateral offset. As a preliminary matter, the downstream media path module 6 knows the paper size and what the CCD or full width array sensor value should be.

Turning now to FIG. 5, initially, as the media 100 is passed through the image sensing unit of the registration system 6, a running average of the lateral position error for five or more sheets is collected (102). This running average represents the DC lateral position error. The DC lateral position error is then fed to the controller 20 (104). This data represents the DC lateral offset value that the closed loop system 4 is to correct. The DC lateral error is the distance in millimeters that the media is off from its expected edge position. The controller then uses this delta error in millimeters to shift the upstream paper path module. A minimum value can be used so that the hardware is not always trying to correct for small lateral errors, which would lead to extra wear and tear on the hardware.

The lateral offset value is then used by the controller 20 to shift at least one upstream paper path module (e.g., the fourth module 14) in the correct direction via the linear actuator to reduce or remove the DC portion of the lateral shift (106). By shifting the module just before the critical downstream subsystem it is possible to reduce any errors that might be added to the system for the components located between the actuator and the sensor.

Accordingly, the media arrives at the downstream paper path modules with very little, if any, DC lateral error. This closed loop control will also give the downstream registration module 6 more time to correct for process and skew errors, which will increase the range of process and skew capability.

Figure 9:
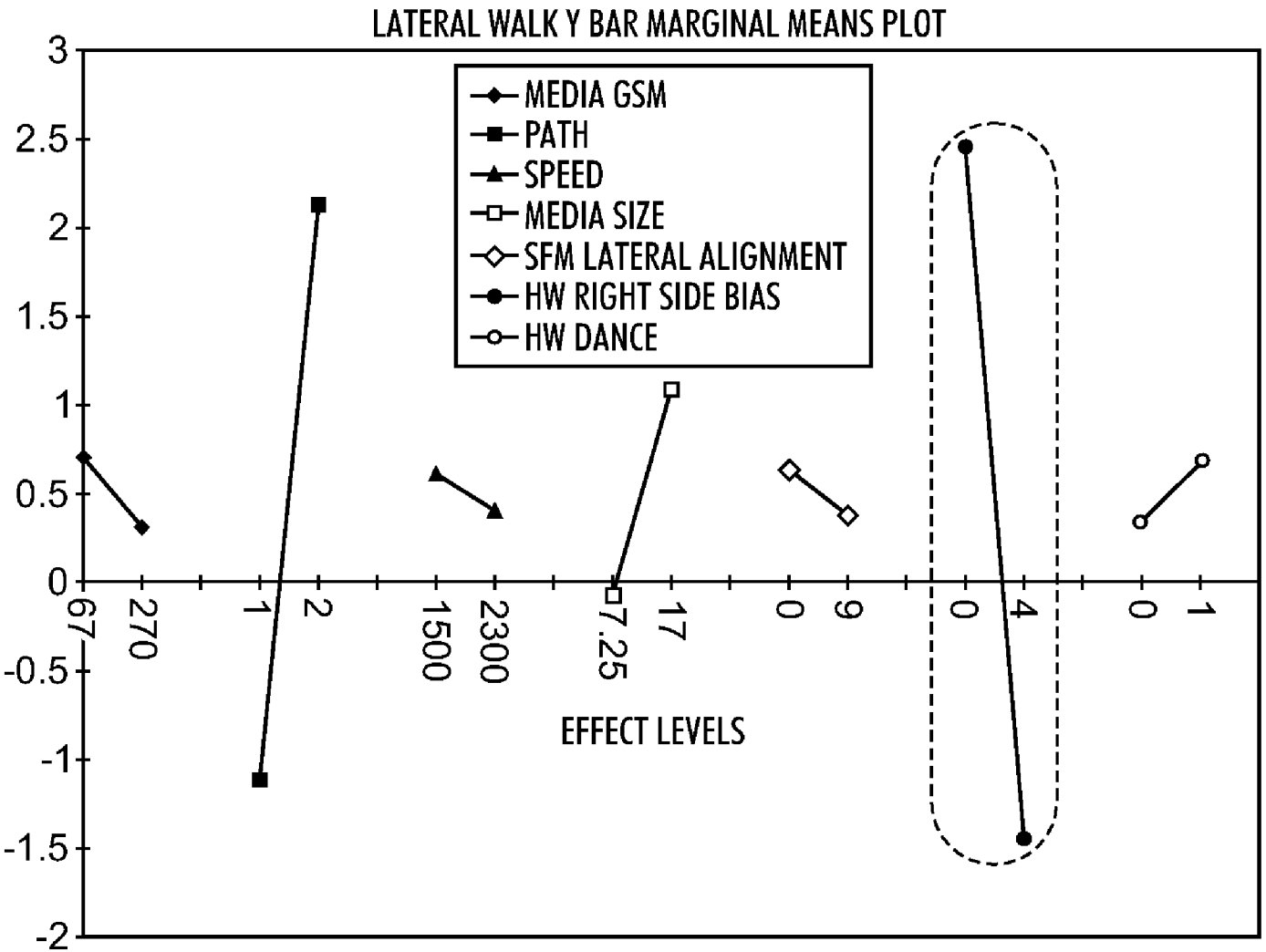
FIG. 9 shows a lateral walk Y bar marginal means plot with the y axis units in mm.
Figure 10:
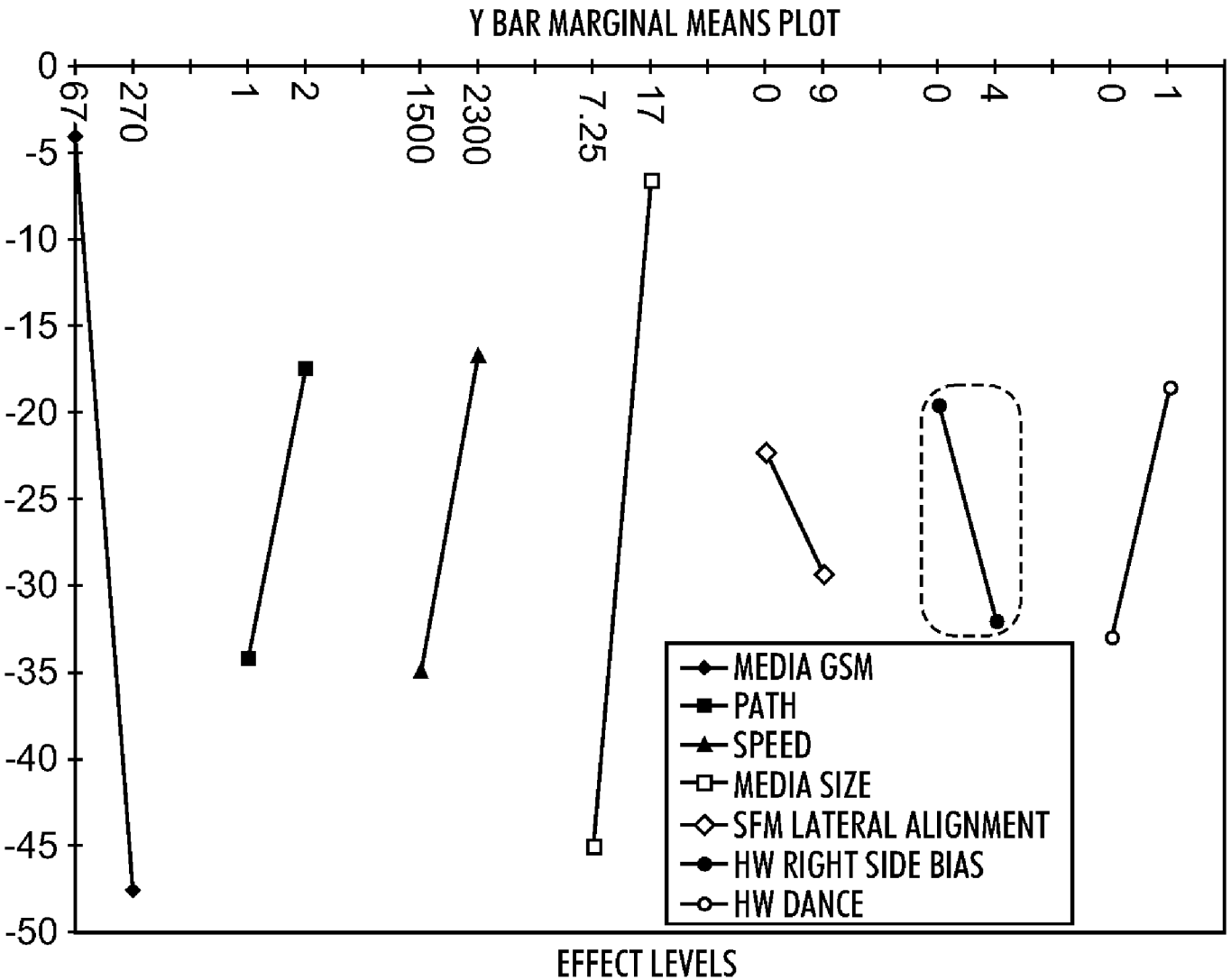
FIG. 10 shows a Y bar marginal means plot with the y axis in mrads.

FIG. 9 shows a lateral walk Y bar marginal means plot with the y axis units in mm. In this regard, past testing shows that it is possible to get a 1:1 ratio of paper path lateral shift to media lateral shift (see circled area). FIG. 10 shows a Y bar marginal means plot with the y axis units in mRads. Testing has also shown that shifting the paper path module does not create an increase in media skew, greater than the other noises tested (see circled area).

Thus, a method to remove media lateral DC position errors in a long paper path using closed loop correction is disclosed. The feedback of the amount of lateral DC media shift error generated (or the lateral DC correction required) in the paper path is sent by a CCD or full width array sensor located in the downstream paper path. In the closed loop this feedback is used to energize a motorized actuator in the upstream paper path to correct for lateral DC errors in the media path. Thus, the paper is delivered to the downstream media path within specifications. In this way, the performance of a downstream registration module in products with long paper paths is increased since the amount of time the registration module is spending to correct for DC lateral errors is decreased.

Some portions of the above description were presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise as apparent from the preceding discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems will be apparent from the description. In addition, the present exemplary embodiment is not described with reference to any particular programming language. It will be appreciated that a variety of programming languages may be used to implement the teachings of the exemplary embodiment as described herein.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; electrical, optical, acoustical or other form of propagated signals (e.g., carrier waves, infrared signals, digital signals, etc.); etc.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method comprising:

collecting a running average of the lateral position error for a plurality of sheets as they pass through an image sensing unit of an image registration system;

feeding the DC lateral position error to a controller; and shifting at least one upstream paper path module via a tension control mechanism to reduce the DC lateral position error for future sheets.

2. The method of claim 1, wherein the image sensing unit comprises a charge coupled device.

3. The method of claim 1, wherein the image sensing unit comprises a full width array sensor.

4. The method of claim 1, wherein the tension control mechanism comprises a linear actuator that moves in a direction perpendicular to the paper path.

5. The method of claim 1, wherein the lateral position error is the distance that the sheet is off from its expected edge position.

6. A closed loop pre-registration method for an image rendering system, the method comprising:

passing more than one sheet through an image sensing unit of a registration system in the image rendering system, wherein the image rendering system has a paper path comprised of more than one image processing module;

collecting a running average of the lateral position error of each sheet;

calculating the DC lateral position error of the sheets;

feeding the DC lateral position error to a controller; and shifting at least one upstream paper path module via a tension control mechanism to reduce the DC lateral position error for future sheets.

7. The method of claim 6, wherein the image sensing unit comprises a charge coupled device.

8. The method of claim 6, wherein the image sensing unit comprises a full width array sensor.

9. The method of claim 6, wherein the image rendering system comprises at least one xerographic printer.

10. The method of claim 6, wherein the tension control mechanism comprises a linear actuator that moves in a direction perpendicular to the paper path.

11. The method of claim 6, wherein the lateral position error is the distance that the sheet is off from its expected edge position.

12. A closed loop pre-registration system for an image processing device having a paper path with two or more image processing modules, the system comprising:

a registration system having an image sensing unit;

a controller;

a feedback loop between the image sending unit and the controller; and a tension control mechanism adapted to shift one of the image processing modules in the paper path upon receipt of a signal from the controller; wherein the controller is operative to:

collect a running average of the lateral position error associated with one or more sheets as they are passed through the image registration unit;

calculate the DC lateral position error of the sheets;

feed the DC lateral position error to the controller via the feedback loop; and shift at least one upstream paper path module via the tension control mechanism to reduce the DC lateral position error for future sheets.

13. The system of claim 12, wherein the image sensing unit comprises a charge coupled device.

14. The system of claim 12, wherein the image sensing unit comprises a full width array sensor.

15. The system of claim 12, wherein the image rendering system comprises one or more xerographic printers.

16. The system of claim 12, wherein the tension control mechanism comprises a linear actuator that moves in a direction perpendicular to the paper path.

17. The system of claim 12, wherein the lateral position error is the distance that the sheet is off from its expected edge position.

* * * * *